US005893823A

United States Patent [19]

Li

[11] Patent Number: 5,893,823

[45] Date of Patent: Apr. 13, 1999

[54] METHOD OF PRODUCING A STRING OF MULTIPLE CLEANSING NET PACKAGES

[75] Inventor: Pei-Kun Li, Changhua Hsien, Taiwan

[73] Assignee: Chien-Chang Enterprise Co., Ltd., Changhua Hsien, Taiwan

[21] Appl. No.: 08/832,060

[22] Filed: Apr. 2, 1997

[51] Int. Cl.[6] ..... B31B 13/00

[52] U.S. Cl. ..... 493/374; 493/379; 493/386; 15/222

[58] Field of Search ..... 15/222, 229.11, 15/229.12, 229.13, 229.14; 493/374, 379, 393, 394, 386

[56] References Cited

U.S. PATENT DOCUMENTS

| | | | |
|---|---|---|---|
| 5,295,280 | 3/1994 | Hudson et al. | 15/222 |
| 5,504,963 | 4/1996 | Bynum et al. | 15/222 |
| 5,560,071 | 10/1996 | Chang | 15/222 |

*Primary Examiner*—James F. Coan
*Assistant Examiner*—Gene L. Kim
*Attorney, Agent, or Firm*—Browdy and Neimark

[57] ABSTRACT

A method of producing a string of multiple cleansing net packages for cleaning and massaging the back of a person taking a bath includes the steps of mounting looped net packages of even or odd numbers onto a U-shaped bracket; and tying a pull loop to the middle of the front portions of the top and the bottom looped net packages; turning the top or/and the bottom looped net packages half turn around clockwisely, depending on the net packages being of an even or odd number; and then binding the middles of the front portions of every two consecutive looped net packages together exclusively and so on so forth, starting from the top or the second looped net packages; and then binding the middles of the rear portions of every two consecutive looped net packages exclusively together and so on so forth, starting from the top or the second looped net package, depending on the looped net packages being of an even or odd number; and then turning clockwisely all the looped net packages on the bracket ¼ turn around; afterwards, the front and rear portions of each looped net packages on the bracket are bound together; at last, the looped net packages on the bracket are removed therefrom to obtain a string of multiple cleansing net packages.

2 Claims, 7 Drawing Sheets

METHOD OF PRODUCING A STRING OF MULTIPLE CLEANSING NET PACKAGES

BACKGROUND OF THE INVENTION

The present invention relates to a method of producing a string of multiple cleansing net packages wherein looped net packages of even or odd number are mounted onto a U-shaped bracket one on top of the other in a serial relationship and a pull loop is attached to the top and bottom looped net packages at the riddle of the front portions of both the looped net packages. Then both the top and bottom net packages are turned in a clockwise direction in a half turn around the bracket if the net packages are of an even number, and only the bottom net package is turned in a half turn around if the net packages are odd numbered. Next, the middle of the front portions of every two consecutive looped net packages and the middle of the rear portions of every two neighboring looped net packages, counting down on from the second looped package disposed just under the top net package, on the bracket are bound together exclusively by threads if they are even numbered; and the top net package is left free and every two of those net packages therebelow are bound together at their front portions, and the middle of the rear portions of every two net packages on the bracket are bound together by threads if they are of an odd number. Afterwards, all the looped net packages on the bracket are turned ¼ turn around; and the middle of the front and rear portions of each looped net package are tied together. At the last stage, the looped net packages are taken off the bracket to form a string of multiple cleansing net packages.

The method of producing strings of multiple cleansing net packages of the present invention uses a U-shaped bracket onto which are vertically mounted a number of looped net packages in serial so as to effectively reduce the necessary working space in one aspect; and the looped net packages are turned into a string of multiple tiny net packages in pairs so that they can be extended by pulling two pull loops at the ends thereof into wavy shapes, better fitting the shape of the back of a person taking a bath in another aspect.

PRIOR ART

Referring to FIG. 1, the general prior art method of producing a string of multiple cleansing net packages includes the following steps:

(a) using a mold 10 having a plurality of evenly spaced vertical positioning posts 11 disposed in parallel at a certain length;

(b) taking a number of net packages 20 and making them into looped form;

(c) mounting each looped net package 20 onto two adjacent positioning posts 11 with two neighboring looped net packages 20 sharing a common positioning post 11 so as to make every two of the consecutively disposed looped net packages superimposed at each positioning post except the positioning post at the terminals;

(d) tying the neighboring overlapped looped net packages 20 together by threads one by one so as to obtain a string of multiple cleansing net packages of the prior art;

(e) tying a pull loop 40 to the rightmost and leftmost looped net packages respectively;

(f) removing all the looped net packages 20 from the mold 10 to obtain a string of multiple net packages, as shown in FIG. 2.

The disadvantages of the prior art described above are that the mold 10 used takes up relatively too much space due to the linear arrangement of the positioning posts 11 in one aspect; and the extended string of the net packages almost in a linear forms, as shown in FIG. 3, so there will be no massage effect produced at all when it is pressed against the back of a person taking a bath.

OBJECT OF THE INVENTION

Therefore, the primary object of the present invention is to provide a method of making a string of multiple cleansing net packages wherein the net packages are mounted onto a U-shaped vertical bracket in the production process so as to effectively reduce the space of a working site.

Another object of the present invention is to provide a method of producing a string of multiple cleansing net packages which has at least two or more net packages that are joined together into a string form having a pull loop at each end thereof so that when pulling the pull loops outwardly, the cleansing net packages can be deformed into a wavy form, so as to conform to the contour of the back of a person using the string of net packages for cleansing and massaging the body.

DETAILED DESCRIPTION OF THE PREFERRED EMBODIMENTS

Figures 4A, 4B, 4C:
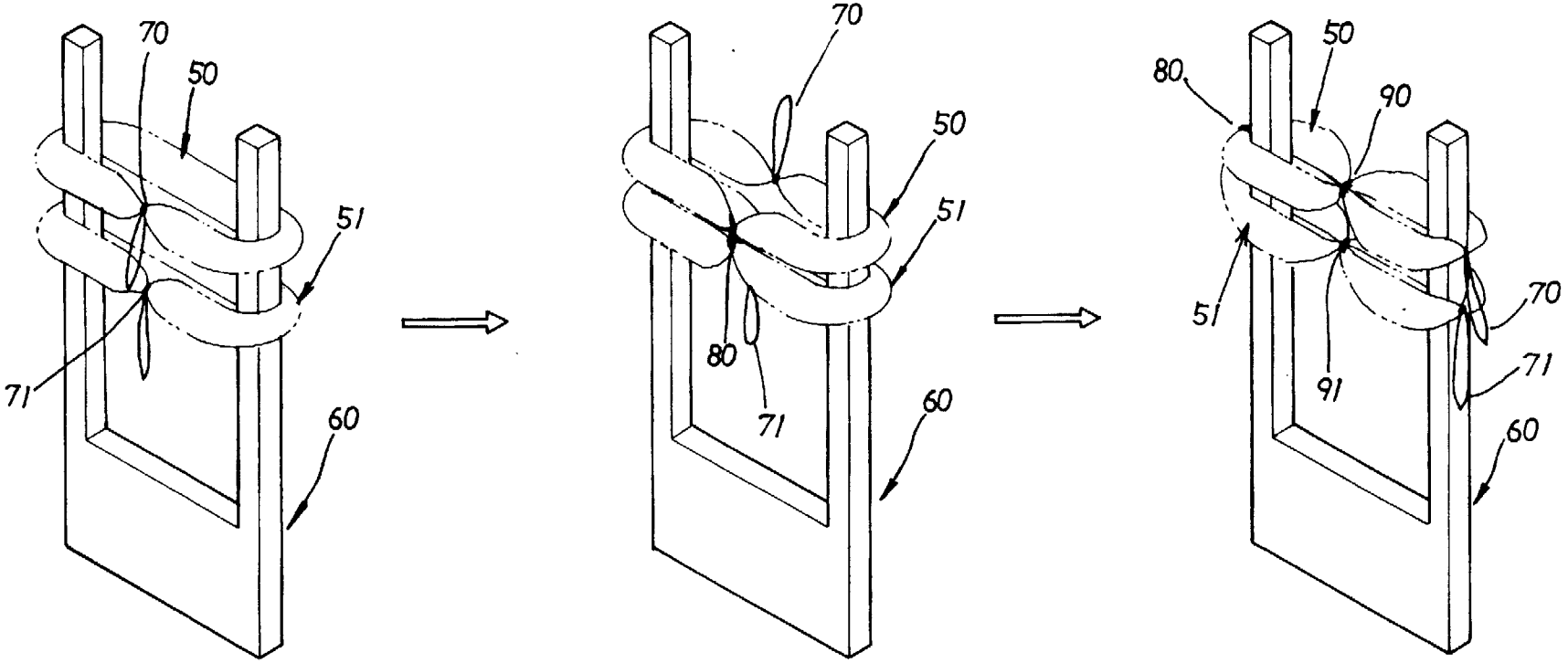
FIG. 4A, 4B, 4C are diagrams showing a process of producing a string of two pairs of looped cleansing net packages of the present invention.

Referring first to FIGS. 4A, 4B, 4C, a string of two pairs of looped cleansing net packages of the present invention is produced according to the following steps:

(a) taking two rings of net packages 50, 51 of proper length and mounting the rings onto a U-shaped bracket 60 one on top of the other;

(b) tying pull loops 70, 71 respectively to the ring of the net packages 50, 51 at a position that locates at the center of a front portion of the net packages 50, 51, extending between two legs of the U-shaped bracket 60;

(c) turning the net packages 50, 51 half around clockwisely to make the tied pull loops 70, 71 to be located at the opposite side of their original positions shown in step (b); and further tying the two net packages 50, 51 together at a new position defined at the middle of the front portion between two legs of the U-shaped bracket 60 with a tying thread 80, as shown in FIG. 4B, on the opposite side of the pull loops 70, 71 now;

(d) making the rings of net packages 50, 51 further ¼ turn around clockwisely so as to shift the knotted threads 80 to the left side of the U-shaped bracket 60 and the pull loops 70, 71 to the right side of the bracket 60; and the two net packages 50, 51 are further tied up together at the front and rear portions between the span of the bracket 60, as shown in FIG. 4C;

(e) removing the two so processed net packages 50, 51 from the U-shaped bracket 60 to get a string of cleansing net packages.

Figure 5C:
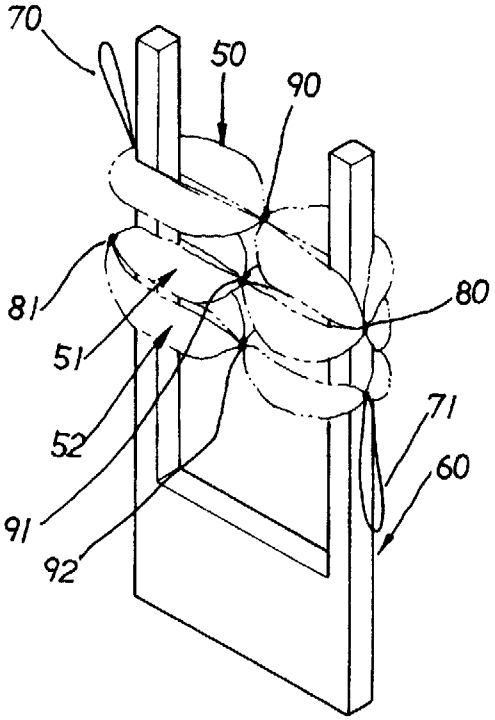
FIG. 5A, 5B, 5C are diagrams showing a process of producing a string of three pairs of looped cleansing net packages of the present invention.
Figure 5B:
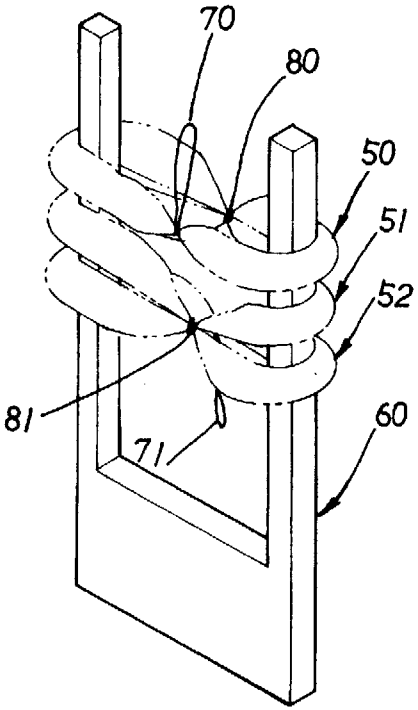
Figure 5A:
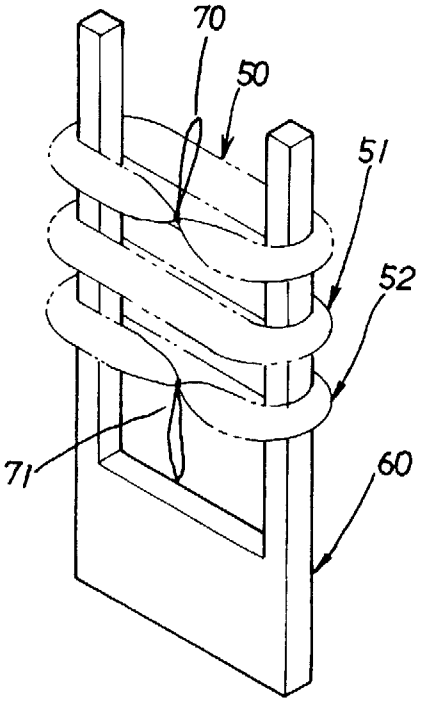

As further shown in FIGS. 5A, 5B, 5C, a string of three pairs of net packages is produced in the following manner;

(a) taking three looped net packages 50, 51, 52 of a proper size and mounting them onto the U-shaped bracket 60 one on top of the other in serial;

(b) tying pull loops 70, 71 respectively to the top and bottom looped net packages 50, 52 at the middle of the front portion extended between the span of the bracket 60, as shown in FIG. 5A;

(c) turning clockwisely the bottom looped net package 52 half around to shift the pull loop 71 to the opposite or the rear portion of the bottom looped net package 52 extended between the span of the bracket 60; and then binding the rear portions of the top and middle looped net packages 50, 51 and the front portions of the middle and bottom looped net packages together by threads 80, 81 at the centers thereof respectively; resulting in the pull loop 70 disposed in opposite to the thread 80 and the pull loop 71 disposed in opposite to the thread 81 respectively;

(d) making all the looped net packages 50, 51, 52 one fourth turn clockwisely to shift the pull loop 70 and the thread 81 to the left side of the bracket 60 and the pull loop 71 and the thread 80 to the right side of the bracket 60; afterwards, the front and rear portions extended between the span of the bracket 60 of the tops middle and bottom looped net packages 50, 51, 52 are bound together by threads 90, 91, 92 respectively to form two rolls of sub-looped net packages, as shown in FIG. 5C.

(e) taking the sub-looped net packages 50, 51, 52 off the bracket 60 to get a string of 3 pairs of looped cleansing net packages.

Figures 6A, 6B, 6C:
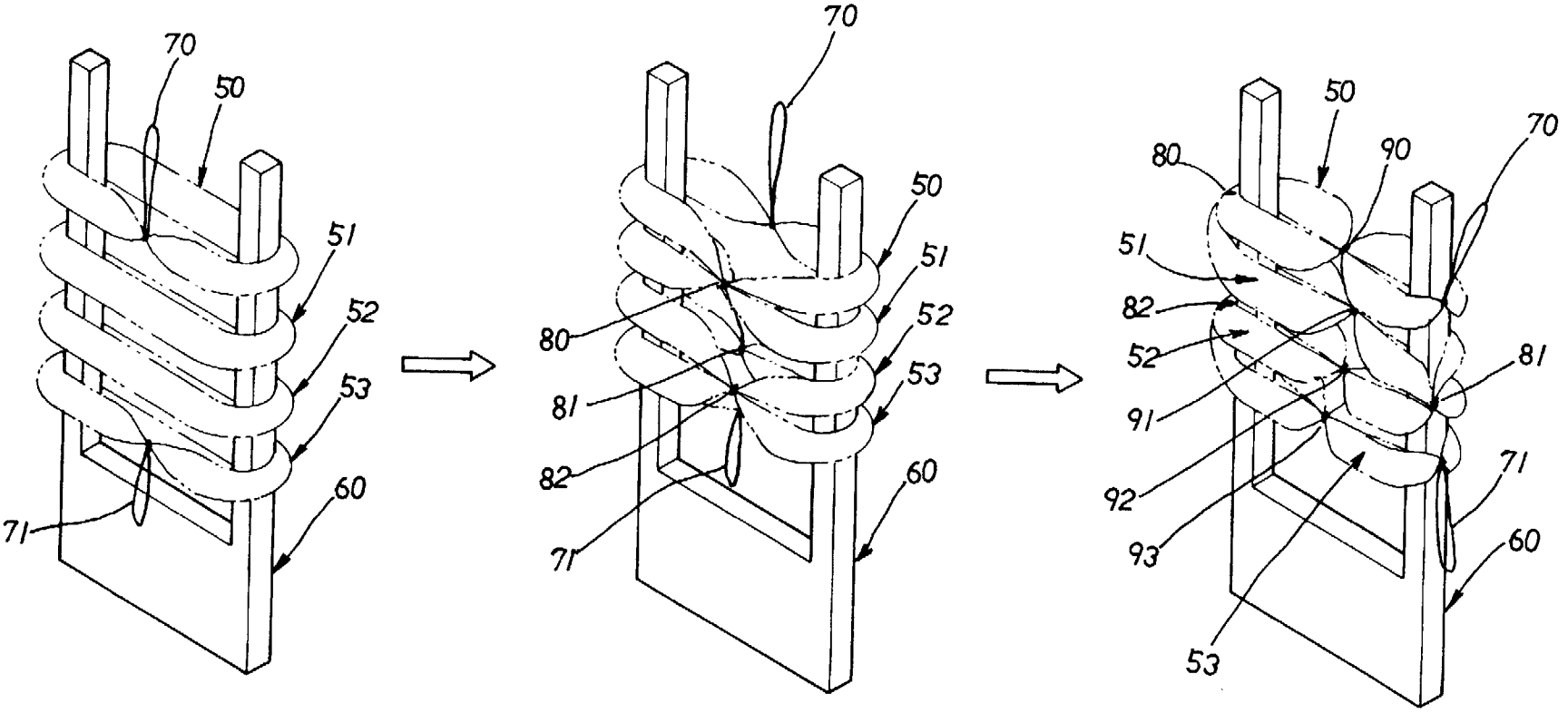
FIG. 6A, 6B, 6C are diagrams showing a process of producing a string of four pairs of looped cleansing net packages of the present invention.

Referring further to FIGS. 6A, 6B, 6C, a string of four pairs of net packages are produced in the following manner;

(a) taking four looped net packages 50, 51, 52, 53 of a proper size and mounting the same onto the U-shaped bracket 60 one on top of the other;

(b) tying pull loops 70, 71 to the middle of the front portions of the top and bottom looped net packages 50, 53;

(c) making the top and bottom looped net packages 50, 53 halfly turned around clockwisely so as to shift the pull loops 70, 71 to the rear portions of the top and bottom looped net packages 50, 53 extended between the span of the U-shaped bracket 60, and then three threads 80, 81, 82 are used to bind the middle of the front portions of the top and the second looped net packages 50, 51 together; and the middle or the rear portions of the second and third looped net packages 51, 52 are tied together by the thread 81; and the middle of the front portions of the third and the bottom looped net packages 52, 53 are bound together by a thread 82, as shown in FIG. 6B, and at this stage, the threads 80, 82 are on the opposite side of the thread 81 and the pull loops 70, 71.

(d) making the above arranged looped net packages 50, 51, 52, 53 further moved ¼ turn clockwisely, shifting the knotted threads 80, 82 to the left side of the bracket 60 and the pull loops 70, 71 and the knotted thread 81 to the right side of the bracket 60; afterwards, the middle of both the front and rear portions of all the four looped net packages 50, 51, 52, 53 are bound together by threads 90, 91, 92, 93.

(e) taking the so arranged looped net packages 50, 51, 52, 53 from the bracket 60 to get a string of four pairs of looped cleansing net packages.

Figures 7A, 7B, 7C:
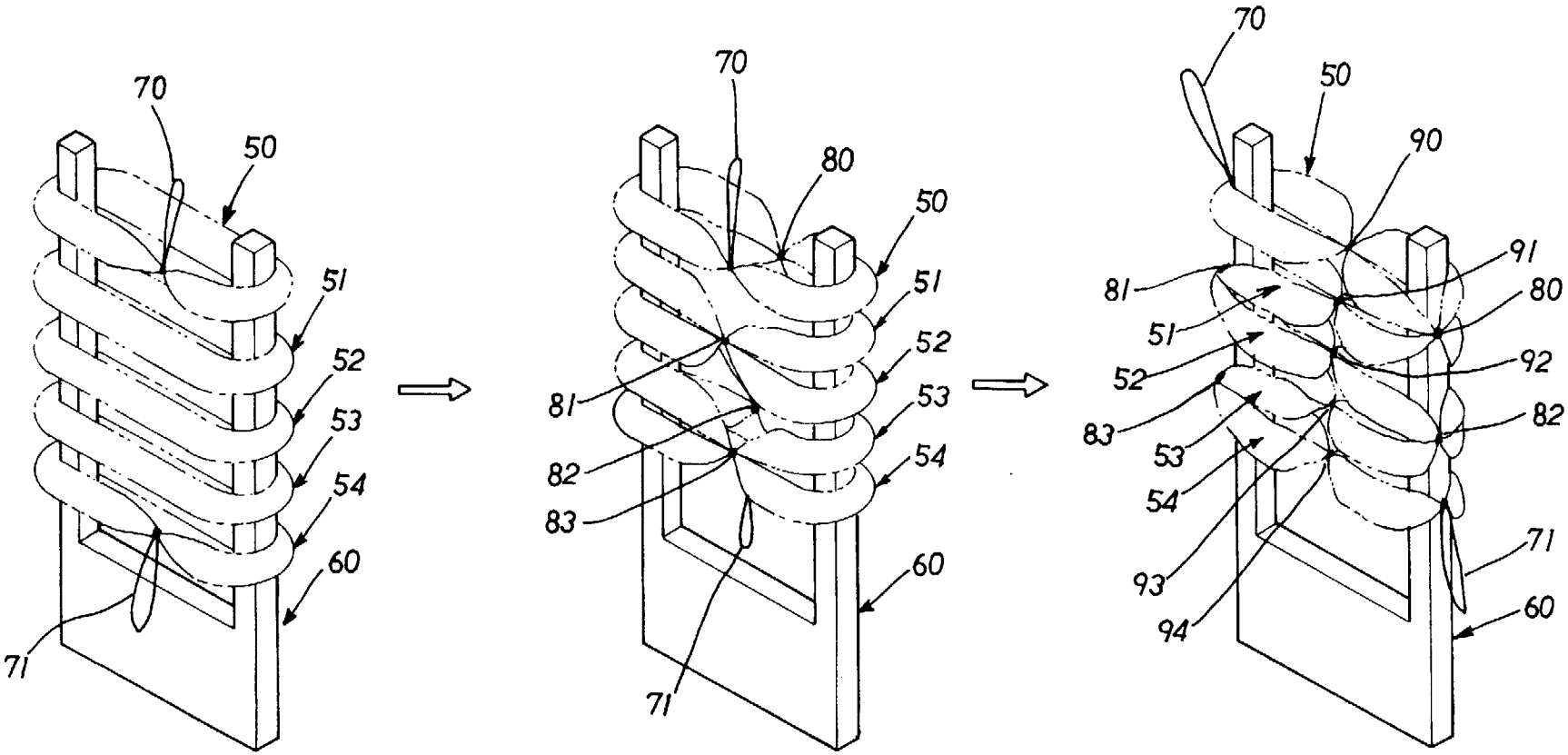
FIG. 7A, 7B, 7C are diagrams showing a process of producing a string of five pairs of looped cleansing net packages of the present invention.

Referring to FIG. 7, a string of five pairs of looped cleansing net packages is produced in the following manner:

(a) taking five looped net packages 50, 51, 52, 53, 54 of a proper size and mounting them onto the U-shaped bracket 60 one on top of the other in serial;

(b) tying pull loops 70, 71 respectively to the top and bottom looped net packages 50, 54 at the middle of the front portions thereof extended between the span of the bracket 60, as shown in FIG. 5A;

(c) turning the bottom looped net package 54 half around clockwisely to shift the pull loop 71 to the opposite or rear portion of the bottom looped net package 52 extended between the span of the bracket 60; and then binding the rear portions of the top and the second looped net packages 50, 51 by a thread 80, and the front portions of the second and the third looped net packages 51, 52 together by a thread 81 at the centers thereof respectively, and the middles of the rear portions of the third and fourth looped net packages 53, 54 by a thread 82, and the middle of the front portions of looped net packages 53, 54 by a thread 83, resulting in the pull loop 70 disposed in opposite to the knotted threads 80, 82 and the pull loop 71 disposed in opposite to the knotted threads 81, 83;

(d) making all the looped net packages 50, 51, 52, 53, 54 one fourth turn around in a clockwise direction to shift the pull loop 70 and the knotted threads 81, 83 to the left side of the bracket 60 and the pull loop 71 and the knotted threads 80, 82 to the right side of the bracket 60; afterwards, the front and rear portions extended between the span of the bracket 60 of the top, the second, third, fourth and the bottom looped net packages 50, 51, 52, 53, 54 are bound together by threads 90, 91, 92, 93, 94 respectively to form two rolls of sub-looped net packages, as shown in FIG. 7C.

Figure 8:
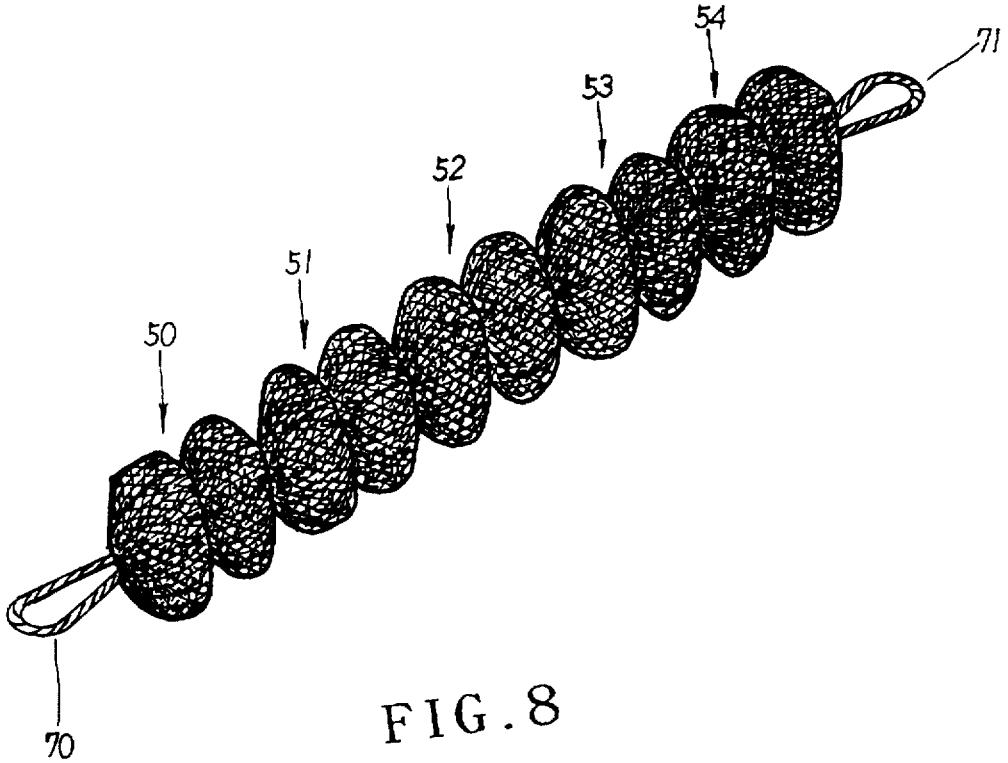
FIG. 8 is a diagram showing a string of five pairs of multiple cleansing net packages of the present invention.

(e) taking the sub-looped net packages 50, 51, 52, 53, 54 off the bracket 60 to get a string of 5 pairs of looped cleansing net packages, as shown in FIG. 8.

Figure 1:
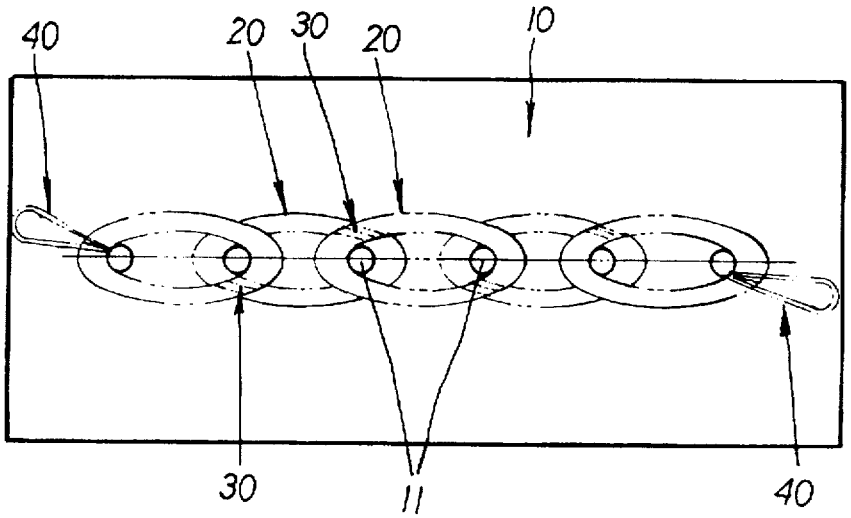
FIG. 1 PRIOR ART
FIG. 1 is a top view showing the way of the assembly of a conventional string of multiple cleansing net packages.
Figure 2:
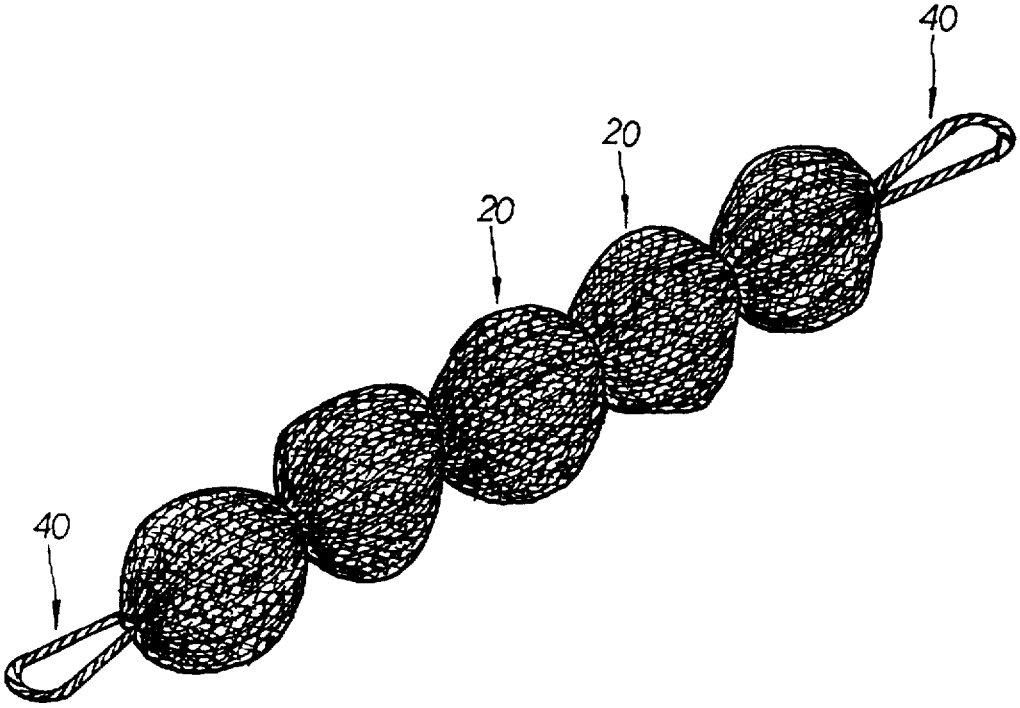
FIG. 2 PRIOR ART
FIG. 2 is a diagram showing the prior art string of multiple cleansing net packages.
Figure 3:
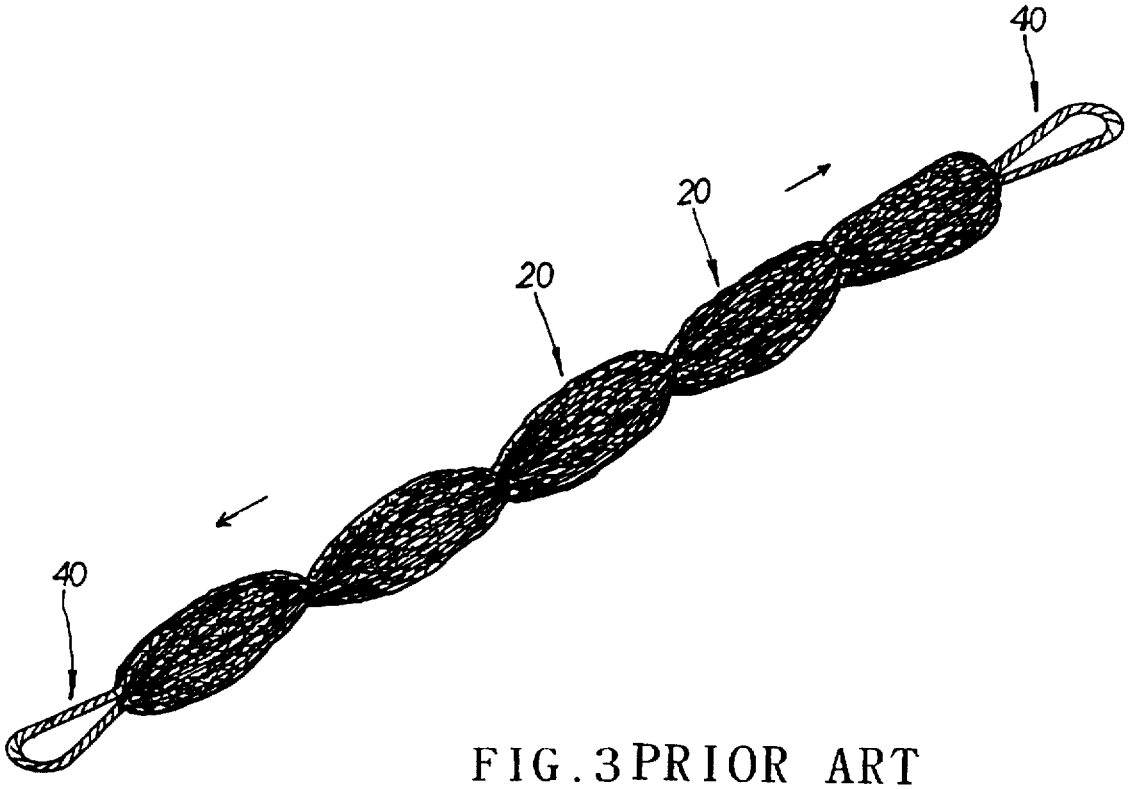
FIG. 3 PRIOR ART
FIG. 3 is a diagram showing an extended string of prior art net packages produced in the manner illustrated in FIG. 1.
Figure 9:
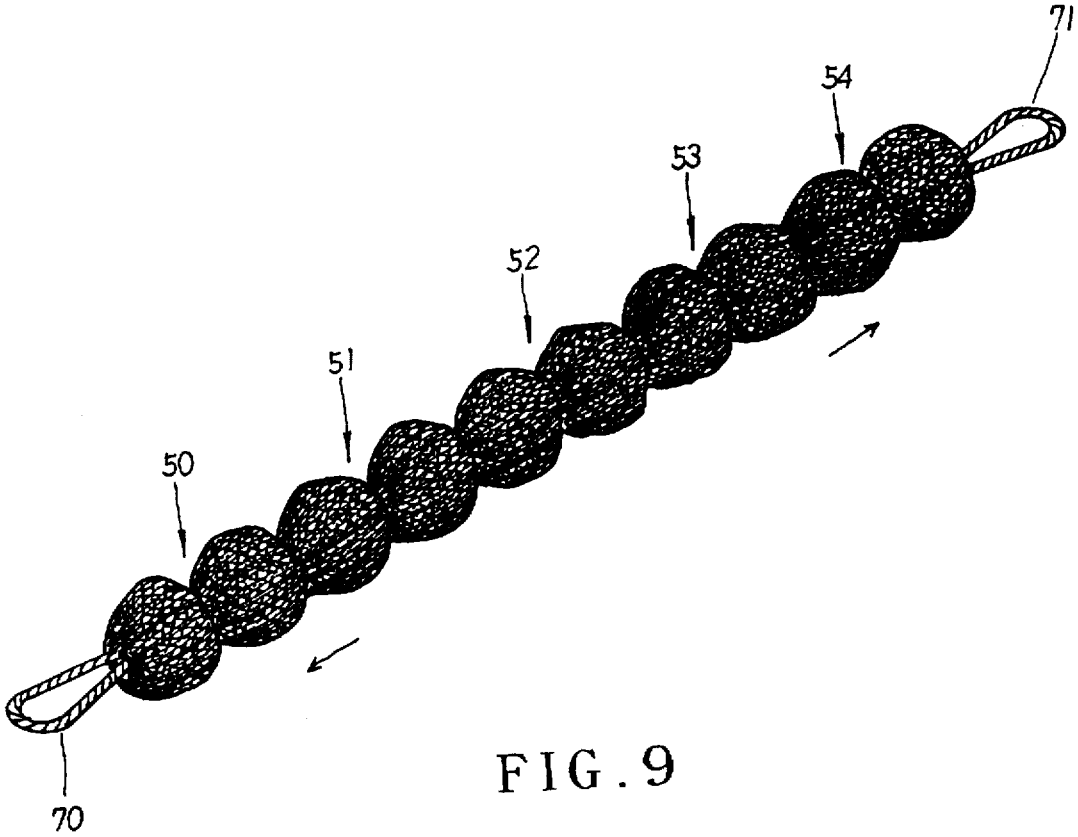
FIG. 9 is a diagram shoving the string of five pairs of multiple cleansing net packages being outwardly extended.

As shown in FIG. 9, the string of 5 pairs of looped net packages is pulled to extend at both ends by the pull loops 70, 71 to transform the net packages into a suppressed wavy shape instead of linear shape of the prior art, as shown in the FIG. 3.

It can be clearly seen that the method of producing a string of multiple cleansing net packages uses a U-shaped bracket 60 onto which are mounted a number of looped net packages for binding arrangement so as to make the working space effectively reduced and the string of multiple looped cleansing net packages can extend into a wavy form to better fit the back of a person taking a bath.

I claim:

1. A method of producing a string of multiple cleansing net packages of an even number comprising the steps of:

(a) taking a plurality of net packages of an even number having a proper length and turning them into a looped form and mounting them onto a U-shaped bracket one on top of the other in a serial relationship, each looped net package of said plurality of net packages extended between said bracket having a front portion and a rear portion;

(b) tying a pull loop to a middle of the front portions of a top looped net package and a bottom looped net package respectively;

(c) turning in a clockwise direction the top looped net package and the bottom looped net package in a half turn around said U-shaped bracket; and then binding a middle of said front portions of every two neighboring looped net packages together by threads, and binding a middle of the rear portions of every two neighboring looped net packages, leaving the top looped net package alone;

(d) turning in a clockwise direction all the above processed loop net packages on said bracket a quarter turn around said U-shaped bracket and binding the front and rear portions of each looped net package on said U-shaped bracket together; and (e) removing said looped net packages from said U-shaped bracket to obtain a string of multiple looped net packages.

2. A method of producing a string of multiple cleansing net packages of an odd number comprising the steps of:

(a) taking a plurality of net packages of an odd number having a proper length and turning them into a looped form and mounting them onto a U-shaped bracket one on top of the other in a serial relationship; each looped net package of said plurality of net packages extended between said bracket having a front portion and a rear portion;

(b) tying a pull loop to a middle of the front portion of a top looped net package and a bottom looped net package respectively;

(c) turning in a clockwise direction the bottom looped net package in a half turn around said U-shaped bracket; and then binding a middle of said front portions of every two neighboring looped net packages together by threads, starting from a second looped net package below the top looped net package, and next binding a middle of the rear portions of every two neighboring looped net packages, starting from the top looped net package (d) turning in a clockwise direction all the above processed looped net packages on said bracket one quarter turn around said U-shaped bracket and binding the front and rear portions of each said looped net package on said U-shaped bracket together; and (e) removing said looped net packages from said U-shaped bracket to obtain a string of multiple looped net packages.

* * * * *